US006811476B2

(12) United States Patent
Ohlendorf

(10) Patent No.: US 6,811,476 B2
(45) Date of Patent: Nov. 2, 2004

(54) GRINDING DEVICE WITH A SUCTION HOOD

(75) Inventor: Oliver Ohlendorf, München (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/315,783

(22) Filed: Dec. 10, 2002

(65) Prior Publication Data

US 2003/0119436 A1 Jun. 26, 2003

(30) Foreign Application Priority Data

Dec. 20, 2001 (DE) ..... 101 62 630

(51) Int. Cl.[7] ..... B24B 55/06
(52) U.S. Cl. ..... 451/456; 451/359
(58) Field of Search ..... 451/456, 344, 451/350, 351, 352, 353, 358, 359, 449, 357, 356, 450, 451; 173/217, 75; 144/252.2

(56) References Cited

U.S. PATENT DOCUMENTS 4,905,420 A * 3/1990 Flachenecker et al. ..... 451/344
4,905,421 A * 3/1990 Maier et al. ..... 451/359
5,218,790 A * 6/1993 Huang ..... 451/359
5,292,352 A * 3/1994 Rudolf et al. ..... 451/41
5,713,785 A * 2/1998 Nishio ..... 451/451
5,791,979 A * 8/1998 Duncan et al. ..... 451/456
5,919,085 A * 7/1999 Izumisawa ..... 451/357
6,053,806 A * 4/2000 Ohlendorf ..... 451/456
6,375,557 B1 * 4/2002 Spangenberg et al. ..... 451/344
6,471,574 B1 * 10/2002 Rupprecht et al. ..... 451/451

FOREIGN PATENT DOCUMENTS

DE 1189405 8/1961
DE 19503201 8/1996

* cited by examiner

*Primary Examiner*—Dung Van Nguyen
(74) *Attorney, Agent, or Firm*—Sidley Austin Brown & Brown

(57) ABSTRACT

A grinding device comprising a motor (2) driven drive shaft (4) projecting from a housing (1). The drive shaft (4) passes through a bearing unit (5). A tool receptacle (8) is provided at a free end (7) of the drive shaft (4) for removably attaching a tool (9), in particular a grinding wheel. A suction hood (11) abuts the housing (1) and encloses the free end (7) of the drive shaft (4). The suction hood (11) comprises a suction space (12) opening in a direction facing the tool receptacle (8) side. The suction space (12) has a separator wall (13) between the tool receptacle (8) and the bearing unit (5) to prevent contamination of the bearing unit (5). The wall divides the suction space (12) into a dirty space (14) that opens facing the tool receptacle (8) and an adjacent driver space (15) that opens to the opposing side.

4 Claims, 1 Drawing Sheet

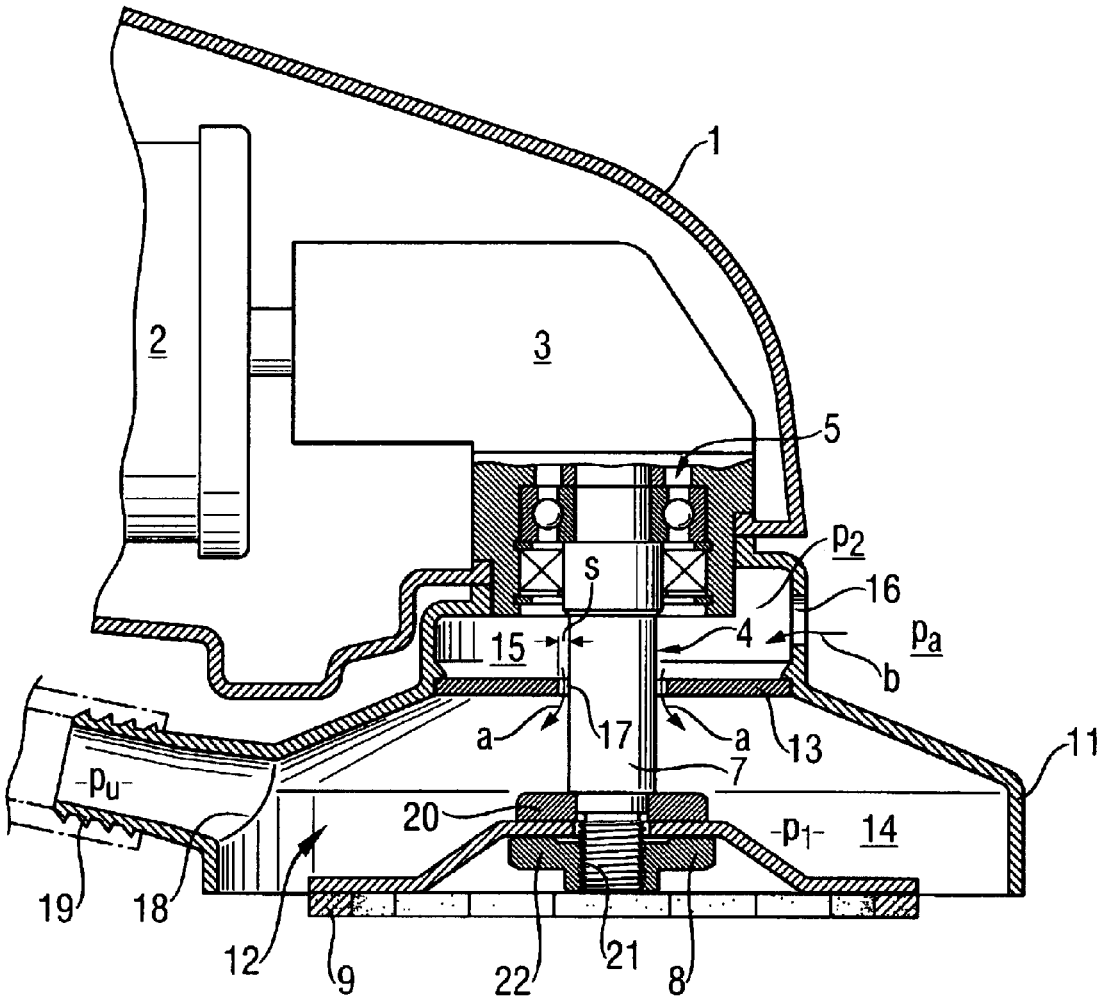
1
2
3
5
$p_2$
16
s
4
$p_a$
15
b
a
17
a
13
11
7
$p_u$
20
$p_1$
14
19
18
12
9
22
21
8

GRINDING DEVICE WITH A SUCTION HOOD

BACKGROUND OF THE INVENTION

The invention relates to a grinding device comprising a housing and motor-driven drive shaft passing through a bearing unit with its free end extending from the housing, wherein at the free end of the drive shaft a tool receptacle is provided for the removable attachment of a tool and an enclosing suction hood abuts at the housing and surrounds the free end of the drive shaft, said hood having a suction space facing the tool receptacle.

Grinding devices of the type described above are used when working a surface using a motor-driven drive shaft, wherein a tool receptacle for removable attachment of a tool, particularly a grinding wheel, is disposed at its free end. Removed particles occur during a grinding operation by the rotary motion of the tool abrasively on the surface of the workpiece, said particles resulting in the development of a heavy dust. A suction hood is arranged on the housing of the grinding device to prevent or at least reduce contamination of the surroundings. The suction hood surrounds the free end of the tool receptacle and comprises a suction space facing the tool receptacle.

DE 195 03 201 A1 discloses a grinding device comprising a housing and a motor-driven drive shaft passing through a bearing unit and projecting from the housing at its free end. A tool receptacle is provided at the free end of the drive shaft for removably fastening a tool. An enclosing suction hood abuts at the housing enclosing the free end of the drive shaft. The hood has a suction space facing towards the tool receptacle. The bearing unit is protected by a seal against the incursion of dust.

The drawbacks of the known solution are that the sealing of the bearing unit is very costly and an incursion of dust into the bearing unit is not preventable.

SUMMARY OF THE INVENTION

The object of the present invention is to provide a grinding device that is economical to manufacture, that efficiently suctions off dust and prevents an incursion of dust into the bearing unit.

This object is achieved by the invention, wherein the suction space comprises a separator wall between the tool receptacle and the bearing unit that divides the suction space into a dirty space openly configured towards the tool receptacle and an adjacent drive space opposite to the tool receptacle. The separator wall comprises a through passage for passage of the drive shaft.

Since the suction space has a separator wall that separates the dust-sensitive parts, such as the bearing unit, from the dust, contamination of the parts by dust is prevented by a simple means, the separator wall.

Preferably, the dirty space comprises at least one discharge opening that is connectable to a source of underpressure [viz. vacuum]. By generating an underpressure in the dirty space, dust incursion into the driver space is prevented entirely since there is an overpressure in the driver space compared with the dirty space.

The driver space comprises at least one inlet opening that is open to the outside to assure an optimal supply of air from the surroundings of the grinding device. In a further embodiment of the invention, the inlet opening comprises an air filter, for example, for filtering dust from the air brought in from the outside.

A clearance is advantageously provided between the inner contour of the passage opening and the external contour of the drive shaft to avoid a seizing up of the drive shaft. Furthermore, the clearance enables an air current between the driver space and the dirty space. The clearance consequently prevents an incursion of dust through the through passage since, in that zone, the stream velocity is very high due to the pressure difference between the drive space and the dirty space.

BRIEF DESCRIPTION OF THE DRAWINGS

The invention is more completely described below with reference to FIGURE, which shows a portion of a grinding device in accordance with the invention.

DETAILED DESCRIPTION OF THE INVENTION

FIG. 1 shows one portion of a grinding device, according to the invention in longitudinal section, comprising a housing 1, a motor 2 (represented only in part), a symbolically represented angle transmission 3 and a drive shaft 4 driven by the motor 2. The drive shaft 4 passes through a bearing unit 5 and projects from the housing 1 with its free end 7. A tool receptacle 8 for removably attaching a tool 9, in particular a grinding wheel, is disposed at the free end 7 of the drive shaft 4. A suction hood 11 adjoins the housing 1 and encloses the free end 7 of the drive shaft 4. The suction hood comprises a suction space 12 open on the side facing the tool receptacle 8.

The suction space 12 comprises a separator wall 13 between the tool receptacle 8 and the bearing unit 5. The separator wall 13 divides the suction space 12 into a dirty space 14, on the side open to the tool receptacle 8, and a driver space 15 adjacent thereto and facing in the opposite direction. Furthermore, the separator wall 13 comprises a passage opening 17 for passage through of the driver shaft 4. A clearance s is provided between the inner contour of the passage opening 17 and the external contour of the driver shaft 4.

The dirty space 14 comprises a discharge opening 18 that is connectable by a suction nozzle 19 to a vacuum source (not shown). The driver space comprises an inlet opening 16 that opens to the outside to form an air conduit from the outside to the driver space 15.

When the grinding machine is operated according to the invention, the dirty space 14 has a lower pressure $p_1$ than the pressure $p_2$ present in the driver space 15. The lower pressure $p_1$ of the dirty space 14 is due to the underpressure generated by the vacuum source. An air current a is created between the driver space 15 and the dirty space 14 by virtue of this pressure difference. The air current occurs particularly between the inner contour of the passage opening 17 and the external contour of the drive shaft 4, which exhibits a high stream current through the small dimensioned clearance in this zone. An air current b is generated from outside into the driver space 15 by the pressure difference produced between the externally present pressure $p_a$ and the pressure $p_2$ that is present in the driver space 15. The dust produced by the grinding operation or other particles is suctioned off by the underpressure $p_1$ present in the dirty space 14 and the underpressure present in the dirty space 14 and sucked out of the dirty space 14 through the discharge opening 18 by the pressure $p_u$ generated by the underpressure source. An incursion of dust or the like into the driver space 15 is prevented by virtue of the air current a.

The tool receptacle 8 comprises a flange 20 fixedly attached to the drive shaft 4 and a nut 22 that can be screwed on the drive shaft 4 by a threaded connector 21. The tool 9 can be fastened either force-fittingly or form-lockingly to the drive shaft 4 between the flange 20 and the nut 22.

What is claimed is:

1. A grinding device comprising a housing (1); a motor-driven drive shaft (4) passing through a bearing unit (5) and projecting from the housing (1) at a free end (7); a tool receptacle (8) positioned at the free end (7) of the drive shaft (4) for removably fastening a tool (9); and a suction hood (11) abutting the housing (1) and enclosing the free end (7); wherein the suction hood (11) comprises a suction space (12) opening onto the tool receptacle (8) side, the suction space (12) comprising a separator wall (13) disposed between the tool receptacle (8) and the bearing unit (5), the separator wall (13) dividing the suction space (12) into a dirty space (14) opening onto the tool receptacle (8) side and a driver space (15) adjacent to the dirty space (14) at an opposite side of said dirty space (15) relative to the tool receptacle (8); and the separator wall (13) comprising a passage opening (17) for passage through of the drive shaft (4).

2. The grinding device of claim 1, wherein the dirty space (14) comprises at least one discharge opening (18) connectable with a source of underpressure.

3. The grinding device of claim 1, wherein the driver space (15) comprises at least one inlet opening (16) open to the outside.

4. The grinding device of claim 1, wherein a clearance is provided between an inner contour of the passage opening (17) and an external contour of the drive shaft (4).

* * * * *